US009186711B2

(12) United States Patent
Benedetti et al.

(10) Patent No.: US 9,186,711 B2
(45) Date of Patent: Nov. 17, 2015

(54) ROLLING LINE AND RELATIVE METHOD

(75) Inventors: Gianpietro Benedetti, Tricesimo (IT); Paolo Bobig, San Canzian d'Isonzo (IT)

(73) Assignee: DANIELI & C. OFFICINE MECCANICHE SPA, Buttrio (IT)

( * ) Notice: Subject to any disclaimer, the term of this patent is extended or adjusted under 35 U.S.C. 154(b) by 0 days.

(21) Appl. No.: 13/704,155

(22) PCT Filed: Jun. 14, 2011

(86) PCT No.: PCT/IB2011/001319

§ 371 (c)(1),
(2), (4) Date: Feb. 27, 2013

(87) PCT Pub. No.: WO2011/158090

PCT Pub. Date: Dec. 22, 2011

(65) Prior Publication Data

US 2013/0160277 A1 Jun. 27, 2013

(30) Foreign Application Priority Data

Jun. 14, 2010 (IT) ..... UD10A0116

(51) Int. Cl.

| | |
|---|---|
| ***B22D 11/12*** | (2006.01) |
| ***B21B 1/26*** | (2006.01) |
| ***B21B 1/46*** | (2006.01) |
| ***B21B 13/22*** | (2006.01) |

(Continued)

(52) U.S. Cl.

CPC ..... *B21B 1/466* (2013.01); *B21B 13/22* (2013.01); *B21B 15/0007* (2013.01); *B21B 1/26* (2013.01); *B21B 15/005* (2013.01); *B21B 45/004* (2013.01); *B21B 2261/04* (2013.01); *Y10T 29/49991* (2013.01)

(58) Field of Classification Search

CPC ..... B22D 11/12; B21B 1/26; B21B 1/46; B21B 13/22

USPC ..... 164/476, 477, 417; 29/527.7

See application file for complete search history.

(56) References Cited

U.S. PATENT DOCUMENTS

| | | | | |
|---|---|---|---|---|
| 4,675,974 | A | 6/1987 | Connolly | |
| 5,329,688 | A * | 7/1994 | Arvedi et al. | 29/527.7 |
| 5,339,887 | A * | 8/1994 | Flemming et al. | 164/476 |

(Continued)

FOREIGN PATENT DOCUMENTS

| | | |
|---|---|---|
| EP | 0625383 | 11/1994 |
| EP | 0937512 | 8/1999 |

(Continued)

*Primary Examiner* — Kevin P Kerns

(74) *Attorney, Agent, or Firm* — Hamre, Schumann, Mueller & Larson, P.C.

(57) ABSTRACT

A rolling line for the production of flat product includes a casting machine to continuously case a thin slab, a temperature maintenance and homogenization unit, a rolling unit a forming stand or roughing stand connected to the exit of the casting machine to reduce the thickness of the slab. The forming stand or roughing stand is configured to perform an adaptive reduction of the thickness of the cast slab smaller than or equal to about 65% at least as a function of the thickness, width and type of material of the finished flat product. The rolling unit is configured to perform a reduction of the reduction of the thin slab coming from the temperature maintenance and homogenization unit to a thickness comprised between about 1.2 mm and about 20 mm by three or fewer double rolling passes through the double rolling stand.

19 Claims, 3 Drawing Sheets

(51) Int. Cl.
*B21B 15/00* (2006.01)
*B21B 45/00* (2006.01)

(56) References Cited

U.S. PATENT DOCUMENTS

| | | | | |
|---|---|---|---|---|
| 5,542,165 | A * | 8/1996 | Coassin et al. | 29/33 C |
| 6,182,490 | B1 | 2/2001 | Ginzburg et al. | |
| 7,954,539 | B2 * | 6/2011 | Benedetti et al. | 164/476 |
| 8,011,418 | B2 * | 9/2011 | Rosenthal et al. | 164/476 |
| 8,087,449 | B2 * | 1/2012 | Benedetti et al. | 164/476 |
| 2010/0059196 | A1 * | 3/2010 | Spitzer et al. | 164/462 |
| 2010/0116380 | A1 | 5/2010 | Seidel et al. | |

FOREIGN PATENT DOCUMENTS

| | | |
|---|---|---|
| JP | 07-185605 | 7/1995 |
| JP | 07-323324 | 12/1995 |
| JP | 08-206704 | 8/1996 |

* cited by examiner

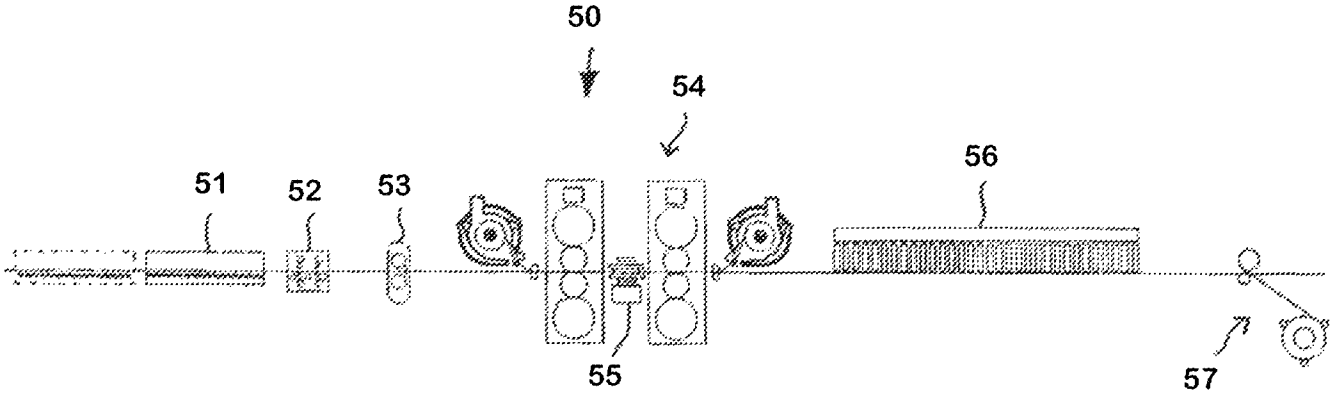
Fig. 1 STATE OF THE ART
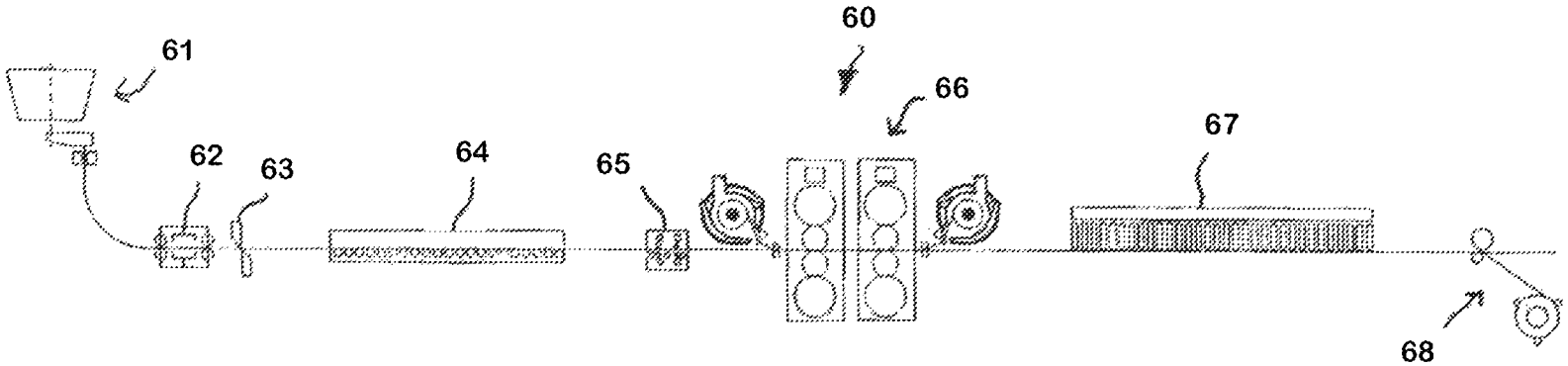
Fig. 2 STATE OF THE ART

Table 5

| | Rolling line 50, fig. 1 | | Line 10 according to the present invention, fig. 3 | | Rolling line 60, fig. 2 | | Rolling line 60, fig. 2 | |
|---|---|---|---|---|---|---|---|---|
| | CASE A | | CASE B | | CASE C | | CASE D | |
| Rolling program | Thick slab (220 mm) | | Adaptive thin slab (35 – 70 mm) | | Thin slab (70 mm) | | Thin slab (50 mm) | |
| | Operating cycle [s] | Operating productivity [ton/h] | Operating cycle [s] | Operating productivity [ton/h] | Operating cycle [s] | Operating productivity [ton/h] | Operating cycle [s] | Operating productivity [ton/h] |
| 01DAT | 555,1 | 141 | 452,0 | 173 | 591,7 | 132 | 572,1 | 137 |
| 02DAT | 498,9 | 144 | 395,1 | 182 | 502,9 | 143 | 410,9 | 175 |
| 03DAT | 426,0 | 230 | 354,4 | 276 | 419,8 | 233 | 412,6 | 237 |
| 04DAT | 398,0 | 213 | 311,7 | 272 | 382,0 | 222 | 311,7 | 272 |
| | Average | 183 | Average | 227 | Average | 185 | Average | 209 |
| | Annual production [ton/year] | 1209806 | Annual production [ton/year] | 1500616 | Annual production [ton/year] | 1219376 | Annual production [ton/year] | 1381092 |
| | | | Average casting speed [m/min] | 5,4 | Average casting speed [m/min] | 4,4 | Average casting speed [m/min] | 7,0 |
| | Comparison with CASE A | | Increased productivity [%] | 24 | Increased productivity [%] | 1 | Increased productivity [%] | 14 |

fig. 4

ROLLING LINE AND RELATIVE METHOD

FIELD OF THE INVENTION

The present invention concerns a rolling line and relative method for the production of flat metal products such as strip or plate.

BACKGROUND OF THE INVENTION

Rolling lines for strip are known which, in order to produce more than 800,000/1,000,000 tons/per year, start from the continuous casting of slabs and using continuous finishing trains with several rolling stands.

If thick slabs are cast, from 130 mm or more in thickness, the continuous finishing train is preceded by a reversing roughing train, whereas if the starting slab is a thin slab, with a thickness of less than 130 mm, for direct rolling, the train is formed simply by 5/9 continuous stands without a roughing train. For productions of less than 800,000/1,000,000 tons/per year a Steckel rolling mill with one or more reversing stands is commonly used, normally fed with slabs having a thickness from 150 to 250 mm.

A rolling line starting from thick slabs normally provides step-wise heating furnaces, a high pressure water de-scaler, a cropping shear, a Steckel reversing rolling train with one or two stands, a laminar cooling system and a winding unit.

Instead, a rolling line starting from thin slabs typically provides a casting machine of thin slabs, a system for the restoration, maintenance or homogenization of the temperature of the cast material, for example a tunnel furnace, a high pressure water de-scaler, a Steckel reversing rolling train with one or two stands, a laminar cooling system and a winding unit.

The rolling plant which starts from thin slabs, compared to that which starts from thick slabs, normally allows a saving, due to the fact that the cropping shear is not required, that the Steckel rolling stand or stands can have smaller diameters of the work rolls, about 740 mm instead of 810 mm: given the same compression, this allows to use rolling forces lower by 20-30%, with subsequent reductions in the sizes of the machine. Moreover, lower rolling forces also produce reduced rolling torque, and the size of the main motors will consequently have a smaller torque value, even less than 15-20%.

It is also known that rolling plants with reversing rolling trains of the Steckel type with one or more stands which use a slab with a thickness from 150 to 250 mm or more have limitations in productivity, in minimum thickness obtainable and in dimensional and surface quality of the final strip; the productivity is limited, given the great thickness of the starting slab, by the high number of rolling passes through the stand or stands and consequently by the long inversion downtimes, with consequently long overall times from the beginning to the end of rolling; this also determines a lack of homogeneity of temperature along the strip, a high temperature loss and the formation of scale which negatively affect the final quality of the strip produced.

Moreover, the high temperature loss makes it impossible to roll thin slabs of finished product, for example from 1.8 to 1.2 mm or less.

Finally, the surface quality of the finished product is also affected by the use of the work rolls for the numerous passes of the cold head and tail ends and the consequent rapid deterioration of the surface of the rolls themselves. In order to reduce this disadvantage it is necessary to change the work rolls frequently, with consequent stoppages, compromising the factor of use and productivity of the plant.

A rolling line is known from document EP-A-0.625-383, consisting of a casting machine able to cast a slab of about 50 mm in thickness, a shearing unit, an inductor furnace, a tunnel furnace, a de-scaler, a two-stand rolling unit of the reversing type, or a continuous type with five stands in line, a cooling unit and a winding unit. The two-stand reversing rolling unit determines a reduction in thickness of the slab to a desired final value of about 1.5-2 mm by means of three double rolling passes. In this known solution, the thickness of the slab entering the reversing rolling unit is the same constant thickness of the slab which is cast. In this way, the known line is not adaptable according to the final thickness and width of the strip and of the type of steel, in order to obtain the final product with a minimum number of passes, because the thickness of the slab entering the reversing rolling unit cannot always be the ideal one; it is thus necessary to modify the thickness of the cast slab, which negatively influences the stability of the casting process. Moreover, in order to minimize the number of rolling passes, the known line has to have a high casting speed and therefore much more stressed working conditions.

Other casting lines and methods are disclosed in EP-A1-937.512, U.S. Pat. No. 4,675,974 and U.S. Pat. No. 6,182,490.

None of these documents, like EP'383, disclose the provision of a forming or roughing stand positioned immediately downstream the casting machine. The only forming or roughing stand provided upstream the Steckel rolling mill is disclosed in EP'512, but in this case the forming stand is located downstream the furnace, therefore not immediately downstream the casting machine. Moreover, the reduction provided in the roughing stand of EP'512 is designed to be up to 50%. None of these documents, therefore, allow to maintain low the number of sequential passes in the Steckel rolling mill for all the range of thicknesses that can be produced by the rolling line.

One purpose of the present invention is to achieve a rolling line with a Steckel rolling train with two reversing stands, and to perfect a relative method, which allows to reduce to a minimum the number of rolling and inversion passes and therefore reduce the total rolling time, with consequent increase in the productivity of the rolling mill, for the whole range of thicknesses that can be produced by the rolling line.

Another purpose is to reduce to a minimum the number of rolling passes, without imposing very stressed working conditions on the line, in particular with regard to the casting speed.

Another purpose of the present invention is to obtain a greater uniformity/homogeneity of the temperature along the strip being rolled and a lower overall temperature loss.

Another purpose is to increase the factor of use of the plant, increasing the working life of the work rolls.

Furthermore, another purpose of the present invention is to exploit to the utmost the great plasticity of the steel at the high temperatures which it has just after it has solidified, to carry out the roughing rolling of the product emerging from the continuous casting machine, so that it is thus possible to use smaller stands and hence with less power installed and with a considerable energy saving. The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In order to obtain all the purposes and advantages set forth above and listed hereafter, the invention provides to feed a two-stand Steckel reversing rolling train with a thin slab, with a constant cast thickness and "modulatable" along the rolling line so that, according to the final thickness and the width of the strip and the type of steel, it is always possible to obtain the final product with three double rolling passes at the most. This reduces to the minimum possible value the number of rolling and inversion passes (and hence the total rolling time and the inversion down-times), hence optimizing the work of the rolling train and increasing its productivity by about 24% compared with the conventional case where the thick slab is used. Moreover, the invention obtains an improved homogeneity and uniformity of the temperature along the strip, with a lower absolute temperature drop, a reduction in the number of times that the cold head/tail ends pass under the work rolls, with a reduced wear of the rolls and hence a better dimensional and surface quality of the final strip, together with the possibility of producing thin thicknesses (from about 20 mm even to about 1.2 mm or less).

According to one feature of the present invention, a rolling line for the production of flat products comprises a casting machine suitable to continuously cast a thin slab, a temperature maintenance and homogenization unit and a rolling unit comprising at least a two Steckel reversing rolling stand.

Furthermore, according to the present invention the rolling line provides, directly connected immediately to the exit of the continuous casting machine and upstream of the temperature maintenance and homogenization unit, at least a forming stand, or roughing stand, able to reduce the thickness of the just solidified material, still at high temperature, typically 1,100-1,180° C.

The at least one roughing stand is configured to allow an adaptive thickness reduction smaller than or equal to about 65% and, exploiting the high temperature at exit from casting and the lower resistance of the material due to the lack of re-crystallization, allows to use smaller stands which require less power installed, and hence to obtain a considerable energy saving. In some forms of embodiment, the adaptive thickness reduction made by the roughing stand is comprised between about 30% and about 65%.

The at least one roughing stand advantageously allows to feed the two-stand Steckel rolling unit with a variable or "modulatable" thickness of the thin slab, at least as a function of the following parameters: strip thickness, strip width, type of steel (or steel grade), so that the finished product is obtained with three double rolling passes at the most.

In some forms of embodiment, the temperature maintenance and homogenization unit is a tunnel furnace of adequate length.

In some forms of embodiment, inside the tunnel furnace the temperature remains below a certain threshold, for example at a value of about 1,150° C.-1,180° C., so that the transport rolls do not have to be water-cooled and therefore "dry rolls" can be used. In this way, the heat dispersions of the slab due to conduction through the rolls can be reduced, and therefore energy is saved and the need for maintenance is reduced.

In other forms of embodiment, the function of the tunnel furnace is to maintain or heat the thin slab so as to obtain, at outlet thereof, a temperature comprised between about 1,150° C.-1,180° C.

Furthermore, in some forms of embodiment of the present invention the tunnel furnace is sized with a length such as to allow an accumulation store for the slabs between casting and the rolling unit, with a stay or buffer time of at least 8 minutes at the maximum casting speed. The buffer time can possibly be increased by reducing the casting speed, and allows to proceed with the programmed roll change of worn work rolls, or to deal with short interruptions in the rolling mill, without having to stop the continuous casting machine and hence without compromising productivity.

According to some forms of embodiment of the present invention, the casting speed is comprised between about 5 m/min and 7 m/min for a thin slab with a constant thickness, at exit from casting, smaller than or equal to about 130 mm. In some forms of embodiment, the thickness at exit from casting is comprised between about 30 mm and about 130 mm. In other forms of embodiment, the thickness at exit from casting is comprised between about 50 mm and about 100 mm.

In some variants, the casting machine can incorporate a dynamic reduction unit to reduce the thickness of the cast slab with liquid core, the so-called "dynamic soft reduction", downstream of the crystallizer, in order to obtain an improved metallurgic structure.

It is clear that by the expression "thickness at exit from casting" we mean the thickness of the cast product directly at exit from the crystallizer, or from the dynamic soft reduction unit, if provided.

In particular, in some forms of embodiment, the thickness obtained with the dynamic soft reduction, starting from a thickness at exit from the crystallizer of smaller than or equal to 130 mm, is comprised between 60 mm and 80 mm.

If the soft-reduction unit is not present, it is the crystallizer itself which directly supplies the final thickness, in some forms of embodiment comprised between 60 and 80 mm of the slab exiting from the continuous casting machine.

Furthermore, in some forms of embodiment of the present invention, the forming or roughing stand is suitable to perform an adaptive reduction in thickness of the thin slab to a thickness comprised between about 30 mm and about 80 mm. In some forms of embodiment the thickness is comprised between about 35 mm and about 75 mm.

Furthermore, according to the present invention, the Steckel reversing rolling unit is suitable to perform a reduction in thickness of the thin slab arriving from the temperature maintenance and homogenization unit to a thickness comprised between about 1.2 mm and about 20 mm by means of at most three double rolling passes through the two rolling stands. In some forms of embodiment, the final thickness is comprised between about 1.4 mm and about 20 mm.

In some forms of embodiment, the diameter of each of the rolling rolls of the forming stand or roughing stand is comprised between about 650 mm and about 750 mm.

The use of the Steckel rolling unit allows to perform the rolling process in coil-to-coil mode, starting from segments of slab, typically with a length between 30 and 75 meters or in any case such as to obtain a coil with a weight comprised between 20 and 30 tons.

The present invention also concerns a rolling method for the production of flat products comprising a continuous casting step of a thin slab, a temperature maintenance and homogenization step, a reversing rolling step after the temperature maintenance and homogenization step, a forming or roughing step, suitable to reduce the thickness of the just solidified slab, performed between the casting step and the temperature maintenance and homogenization step.

Furthermore, the forming or roughing step immediately downstream of the continuous casting performs adaptive reductions of less than 65% of the thickness of the thin slab cast, at least as a function of the thickness, width and type of material of the finished flat product, and the rolling step performs a reduction of the thin slab to a thickness comprised between about 1.2 mm and about 20 mm, using at most three double rolling passes. In some forms of execution of the method, the adaptive thickness reduction is comprised between about 30% and about 65%.

In some forms of embodiment of the present invention, the casting step is performed at a speed comprised between about 5 m/min and 7 m/min of a thin slab with constant thickness at exit from casting of smaller than or equal to about 130 mm, and with a thickness comprised between 60 mm and 80 mm after the soft-reduction, if provided; the forming or roughing step performs an adaptive thickness reduction of the thin slab to a thickness comprised between about 30 mm and about 80 mm, in some forms of embodiment between about 35 mm and about 75 mm. In some forms of execution of the method, the thickness of the cast product at exit from casting is comprised between about 30 mm and about 130 mm. In further forms of execution the thickness at exit from casting is comprised between about 50 mm and about 100 mm.

In some forms of execution of the method according to the present invention, in the first double rolling pass a first reduction in thickness is provided, comprised between about 30% and 40%.

In some forms of execution of the present invention, in the first double rolling pass a second reduction in thickness is provided, comprised between about 30% and 52%.

Furthermore, in some forms of execution, in the second double rolling pass a first reduction in thickness is provided, comprised between about 28% and 50%.

In some forms of execution of the method according to the present invention, in the second double rolling pass a second reduction in thickness is provided, comprised between about 28% and 50%.

Furthermore, in some forms of execution, in the third double rolling pass a first reduction in thickness is provided, comprised between about 24% and 39%.

In some forms of execution according to the present invention, in the third double rolling pass a second reduction in thickness is provided, comprised between about 20% and 25%.

The percentages indicated refer to the reduction expressed in percentage terms of the thickness of the thin slab fed to the double pass that is performed on each occasion.

The disposition of the roughing or forming stand directly connected immediately downstream of casting allows to feed the Steckel reversing rolling unit with a slab of varying thickness, according to the final thickness and width of the strip and the type of steel, in order to obtain the final product with at most three double rolling passes. Consequently, the roughing stand ensures that the thickness of the slab entering the reversing rolling unit is always the ideal thickness, without having to modify the thickness of the cast slab, thus stabilizing the casting process.

In some forms of embodiment, for steels sensitive to cracks at the edges, for which the rolling action of the forming or roughing stand immediately downstream of casting could promote the formation of such cracks, the present invention advantageously provides to adopt a suitable secondary cooling system downstream of the crystallizer, which keeps the edges of the slab "hot".

Another advantage of this disposition of the roughing stand is that, considering a determinate lay-out of the line and given the same hourly productivity and slab thickness at exit from the temperature maintenance and homogenization unit, it allows to cast at a slower speed, and hence in a more stable and problem-free manner for the casting, with fewer risks of casting malfunctions, such as breakout and sticking.

Or, again considering a determinate lay-out of the line and given the same casting speed and slab thickness at exit from the temperature maintenance and homogenization unit, this disposition of the roughing stand allows to cast a thicker slab and hence to increase the productivity of the continuous casting machine.

In some forms of embodiment, the line according to the present invention comprises at least a rapid heating unit of the cast material, for example an induction furnace, disposed between the casting machine and the rolling unit. For example, the rapid heating unit can be upstream of the roughing stand, or between the roughing stand and the temperature maintenance and homogenization unit, or again downstream of the latter, before the rolling unit.

In some forms of embodiment, the line comprises a first de-scaler upstream of the forming or roughing stand.

In other forms of embodiment, the line according to the present invention comprises a second de-scaler downstream of the temperature maintenance and homogenization unit.

Furthermore, in some forms of embodiment, the line according to the present invention comprises a shearing to size unit, disposed downstream of the casting, before the forming or roughing stand.

Moreover, according to some forms of embodiment of the present invention, the line comprises, downstream of the rolling unit, a cooling unit and one or more units for winding the final product.

Thanks to the thin slab produced by the continuous casting and the subsequent modulation of the thickness in the roughing stand immediately downstream, it is possible to feed the two Steckel stands, instead of with a conventional slab, with a thin and adaptive slab and consequently the total number of passes in the stand drops on average by 4-8 times, with a consequent increase in productivity of the rolling mill and quality of the final strip both for surface and for tolerances, thanks to the reduction in variation in temperature between the head/tail ends and the central part of the strip, and less wear on the work rolls.

The present invention not only allows to save energy but also increases productivity by about +24% compared with a conventional process with thick slab.

BRIEF DESCRIPTION OF THE DRAWINGS

These and other characteristics of the present invention will become apparent from the following description of a preferential form of embodiment, given as a non-restrictive example with reference to the attached drawings wherein:

FIG. 1 shows schematically one form of embodiment of a rolling line for thick slabs in the state of the art;

FIG. 2 shows schematically one form of embodiment of a rolling line for thin slabs in the state of the art;

FIG. 4 shows a Table 5 reporting the results of a comparison in the productivity of the state-of-the-art rolling lines in FIGS. 1 and 2 and the rolling line in FIG. 3 according to the present invention.

DETAILED DESCRIPTION OF A PREFERENTIAL FORM OF EMBODIMENT

Figure 3:
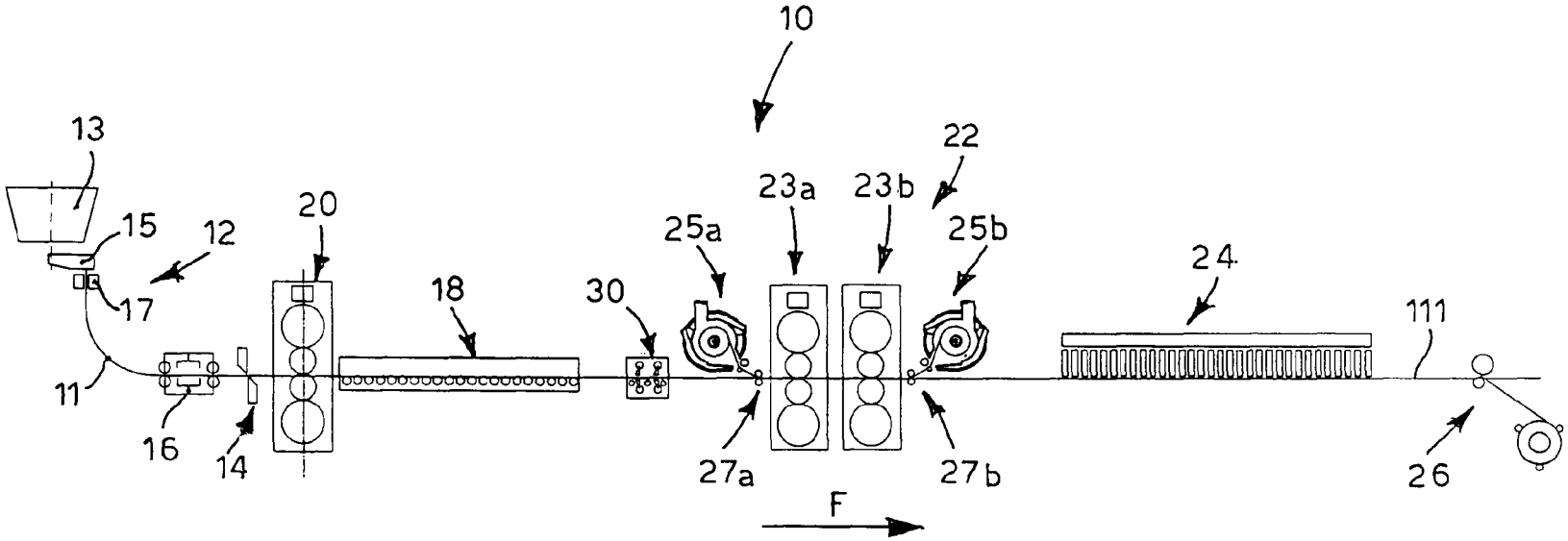
FIG. 3 shows schematically one form of embodiment of a rolling line according to the present invention.

With reference to the attached drawings, FIG. 1 shows a state-of-the-art rolling line 50 for thick slabs. The rolling line 50 comprises one or more heating furnaces 51 of the step-wise feed type, a high-pressure water de-scaler 52, a cropping shear 53, a two-stand Steckel reversing rolling train 54 provided with a trimmer 55 for the edges, a cooling unit 56 of the laminar shower type and a winding unit 57. The rolling line 50 performs a process with a standard thickness slab by means of one or more inversion passes. The rolling line 50 starts from a thick slab with a thickness of 220 mm, width 800-160 mm, maximum length 11.6 m, maximum weight of the slab 30 tons, to produce coils with a thickness of 1.6-20 mm, width from 800 to 1600 mm and specific weight of about 20 kg/mm.

FIG. 2 shows a state-of-the-art rolling line 60 for the production of thin slabs. The rolling line 60 comprises a casting machine 61 for thin slabs, a rotary de-scaler 62, a pendulum shear 63, a tunnel furnace 64, a de-scaler 65 of the pressurized water type, a two-stand Steckel reversing rolling train 66, a cooling unit 67 of the laminar shower type and a winding unit 68. In the rolling line 60, the thickness of the slab entering the Steckel is the same thickness as the cast slab. The rolling line 60 starts from a thick slab with a thickness of 50 mm or 70 mm, width 800-160 mm, maximum length 51.3 m, maximum weight of the slab 30 tons, to produce coils with a thickness from 1.4-1.6 to 20 mm, width from 800 to 1600 mm and specific weight of about 20 kg/mm.

FIG. 3 shows a rolling line 10 according to the present invention for the production of flat rolled products, for example strip/sheet 111, which comprises a continuous casting machine 12, which in this case produces a thin slab 11. The machine 12 in this case is of the type with a through volume, with the thickness of the narrow sides at exit selected from a range from about 30 mm to about 130 mm, and allows to cast a vast range of steels. Traditionally, the machine 12 has a ladle 13, a tundish 15 and a crystallizer 17.

In some forms of embodiment the machine 12 is suitable to cast a thin slab 11 with a thickness, referring to the narrow sides, smaller than or equal to about 130 mm, for example from about 30 mm to about 130 mm, at exit from casting, or directly from the crystallizer 17 or the dynamic soft-reduction, if provided, as explained hereafter. The exit section of the crystallizer 17 can be with the wide sides straight and parallel, or shaped, for example concave-convex or lenticular, while the narrow sides can be straight and parallel or rounded, for example concave.

In some forms of embodiment, in the curved path shown in the drawings at exit from the crystallizer 17, the slab 11 can be subjected to a dynamic reduction in thickness with a liquid core, or dynamic soft-reduction, in order to obtain a better metallurgic structure. In some forms of embodiment, the thickness obtained with the dynamic soft-reduction, starting for example from a thickness at exit from the crystallizer 17 from 30 mm to 130 mm, is comprised between 60 mm and 80 mm.

If the soft-reduction is not carried out, it is the crystallizer 17 itself that directly supplies the final thickness, comprised for example between 60 mm and 80 mm of the slab exiting from the continuous casting machine.

In particular, according to the present invention the rolling line 10 in FIG. 3 starts from a thin slab which is cast with a constant thickness, at exit from the crystallizer 17, chosen from a range between about 30 mm and about 130 mm. In some forms of embodiment, the thickness of the thin slab at exit from the casting machine, considered directly at exit from the crystallizer 17 or from the dynamic soft-reduction if provided, is about 70 mm.

In some forms of embodiment, the thin slab cast has a width of 800-1600 mm, maximum length of 73.3 m and maximum weight of the slab 30 tons.

The rolling line 10 according to the present invention is configured overall to produce coils with a thickness of about 1.2-1.6 mm to about 20 mm. In some forms of embodiment, the coils have a width of from 800 to 1600 mm and a specific weight of about 20 kg/mm.

Normally, the casting speed of the slab 11 goes from 3 to 12 m/min. In the present invention, the casting speed of the rolling line 10 is advantageously maintained at a stable value comprised between about 5 m/min and about 7 m/min, for example about 5.4 m/min.

The main direction and sense of advance of the product cast and rolled along the rolling line 10 according to the present invention is indicated in the attached drawings by the arrow F.

In some forms of embodiment, if the process so provides, after the crystallizer 17, the thin slab 11 is sent to a first shearing unit 14 by means of which the slab 11 is sheared to size.

The first shearing unit 14 is a known type and advantageously synchronized with the casting speed.

In some forms of embodiment, the first shearing unit 14 can comprise a pendulum shear. In other forms of embodiment, the first shearing unit 14 can comprise one or more oxyacetylene torches, depending on the thickness of the cast slab 11.

During the production cycle, the first shearing unit 14 shears the slab 11 into segments of a desired length, correlated to the desired weight of the coil of final strip or sheet, typically segments from 30 to 75 meters long.

In particular, the length of the segments of slab is such as to obtain a coil of a desired weight, for example 25 tons, so that a rolling process is achieved in the so-called coil-to-coil mode.

The first shearing unit 14 is also suitable for emergency scrap shearing into segments of a length between 200 and 450 mm, and to discharge the scrap, or for shearing to size into short segments of 3-4 meters in the course of the emergency cycle, in coordination with an emergency speed of the casting machine 12.

In some forms of embodiment, upstream of the shearing unit 14, after casting, a first de-scaler 16 may be provided. In some forms of embodiment, the first de-scaler 16 is preferably of the type with rotary nozzles and carries out a precise removal of the scale from the surface of the cast product, using the minimum delivery of water possible, thus causing only a slight drop in temperature of the cast product.

Traditionally, downstream of the first shearing unit 14 along the rolling line 10 a temperature maintenance and homogenization unit is disposed, in this case a tunnel furnace 18.

The tunnel furnace 18 has the purpose at least of maintaining the temperature of the slab 11 and is possibly heated and/or insulated so as to prevent or reduce drops in temperature of the material, homogenizing the temperature of the slab 11.

In some forms of embodiment, inside the tunnel furnace the temperature remains below a certain threshold, for example about 1,150° C.-1,180° C., so that the transport rolls do not have to be cooled with water and therefore "dry rolls" can be used. In this way, the heat dispersions of the slab due to conduction through the rolls can be reduced, and therefore energy is saved and the need for maintenance is reduced.

According to the present invention, immediately downstream of the casting machine 12 and upstream of the temperature maintenance and homogenization unit, in this case the tunnel furnace 18, a roughing stand 20 is also provided. In some forms of embodiment, a plurality of roughing stands 20 can be provided, located in series. Typically, in some forms of embodiment, each roughing stand 20 is a four-high stand.

According to the present invention, the working diameter of the rolls of the roughing stand 20 is comprised between 650 mm and 750 mm, preferably between 675 mm and 725 mm, for example about 700 mm. The length of the rolls is about 1500-1800 mm, for example about 1750 when the diameter is 700 mm.

Furthermore, in some forms of embodiment, the separation force of the roughing stand 20 is about 3200 tons (32000 kN).

Moreover, in some forms of embodiment, the nominal power of the motor of the roughing stand 20 is 1200 kW, with speed values at normal working conditions of 100-200 rpm.

In this case, the roughing stand 20 is disposed downstream of the continuous casting machine 12, between the first shearing unit 14 and the tunnel furnace 18.

The function of the roughing stand 20 is to adaptively reduce the thickness of the slab 11 when the solidified core is still very hot, immediately at exit from the casting machine 12. According to the present invention, adaptive reductions of less than about 65% are obtained, for example comprised between about 30% and about 65%, of the initial thickness. In some forms of embodiment, the roughing stand 20 reduces the thickness of the slab 11 up to 30-80 mm. In other forms of embodiment, the reduction reaches about 35-75 mm.

The reduction action on the thickness of the slab 11 by the roughing stand 20 determines an increase in the speed of advance of the slab 11 at exit from the roughing stand 20, which generally may be equal to double the casting speed at most.

The main advantage of this disposition of the roughing stand 20 is that the adaptive thickness reduction is performed when the slab 11 still has a hot core, which requires a smaller stand and hence a lower power installed, with consequent energy saving.

In some modes of use of the invention, such as for example the production of some grades of steel that are particularly sensitive to cracks, the roughing stand 20, or more than one if provided, can remain open, and therefore without performing any reduction in the thickness of the slab 11.

Downstream of the tunnel furnace 18, the rolling line 10 provides a rolling train 22.

According to the present invention, the rolling train 22 is the two-stand reversing type.

In particular, the invention adopts the solution of a two-stand Steckel rolling train 22, formed by two Steckel stands 23*a*, 23*b*, in cooperation with winding/unwinding reels 25*a*, 25*b*, in some forms of embodiment heated reels, also called reel furnaces. The winding/unwinding reels 25*a*, 25*b* cooperate with respective drawing units 27*a*, 27*b*.

The working diameter of the rolls of each Steckel stand 23*a*, 23*b* is about 740 mm, with a length of about 2050 mm.

The working diameter of the rolls of each winding/unwinding reel 25*a*, 25*b* is about 1350 mm, with a length of 2050 mm.

The rolling method according to the present invention provides at most three double passes through the stands 23*a*, 23*b*, which determine desired reductions in thickness.

In particular, with this solution, in the typical production of strip and/or sheet 111, the slab 11 is made to pass a first time through the stands 23*a* (first reduction in thickness of the first double rolling pass comprised between about 30% and 40%), and 23*b* (second reduction in thickness of the first double pass comprised between about 30% and 52%), for sequential reductions of the thickness.

If strip is produced, the strip exiting from the second stand 23*b* is wound onto the second winding/unwinding reel 25*b*.

Afterward, the direction of the strip/sheet is inverted, for a second rolling pass through the stands 23*b* (first reduction in thickness of the second double pass comprised between about 28% and 50%) and 23*a* (second reduction in thickness of the second double pass comprised between about 28% and 50%), to further reduce the thickness.

If strip is produced, the strip exiting from the first stand 23*a* is wound onto the first winding/unwinding reel 25*a*.

If sheet is produced, the winding/unwinding reels 25*a* and 25*b* are excluded from the process and the entire length of the sheet is made to pass from one side to the other of the rolling train 22.

Finally, the direction of feed is inverted a third time for a third rolling pass through the stands 23*a* (first reduction in thickness of the third double pass comprised between about 24% and 39%) and 23*b* (second reduction in thickness of the third double pass comprised between about 20% and 25%) which reduce the thickness to the desired final value.

The thickness at exit from the Steckel rolling train 22 is set to an appropriate value so as to perform the rolling step in the Steckel with three double passes, according to the desired final thickness of the strip 111, advantageously from about 20 mm to about 1.2 mm or even less.

According to one form of embodiment of the present invention, the rolling line 10 may comprise, between the casting machine 12 and the rolling train 22, at least a rapid heating unit, for example an induction furnace, not shown in the drawings.

In some forms of embodiment, as soon as the slab 11 leaves the tunnel furnace 18 it is subjected to de-scaling by means of a second high-speed de-scaler 30 and then passes to the rolling train 22.

In some forms of embodiment, the second de-scaler 30 is the type with static nozzles, and operates at extremely high pressure, which can reach 400 bar.

In some functioning modes of the invention, if the rolling train 22 is stopped for an emergency (for example jamming), or a programmed stoppage (for example a roll change), the tunnel furnace 18 is conformed to allow it to accumulate some segments of pre-rolled slab—the transfer bar—inside it without stopping the casting machine, thus functioning as a store, and then re-introduces them into the rolling line 10 when the rolling train 22 starts up again. The bar stays inside the tunnel furnace 18 (buffer time) for at least 8 minutes at the maximum casting speed or more, suitably slowing down the casting.

Furthermore, after the rolling train 22, the rolling line 10 includes an exit roller-way for the strip/sheet 111, at a speed of about 1.5-12 m/sec, and a cooling unit 24. For example, the cooling unit 24 is the type with laminar shower cooling.

Downstream of the cooling unit 24 the rolling line 10 comprises at least a winding unit 26, for example formed by one or more down coilers of the strip/sheet 111 produced in subsequent workings, to produce the coils.

COMPARATIVE EXAMPLES

In order to demonstrate that the rolling line 10 according to the present invention allows to increase productivity, even by 24%, there now follow some comparative examples with the state-of-the-art rolling lines 50, 60.

In order to compare typical productions, some representative rolling programs were considered (Table 1).

TABLE 1

| Number | Type of steel | Strip thickness [mm] | Strip width [mm] |
|---|---|---|---|
| 01DAT | Low carbon content | 1.6 | 1200 |
| 02DAT | Low carbon content | 2.0 | 1100 |
| 03DAT | Medium carbon content | 4.0 | 1500 |
| 04DAT | High carbon content | 8.0 | 1300 |

We assume a product mix with the following average properties:

average strip thickness: 3.8 mm;

average strip width: 1270 mm;

specific weight of strip: 18 kg/mm.

Furthermore, the following rolling program (Table 2) was calculated for the rolling mode that starts from thin slab (rolling line 60, FIG. 2, and rolling line 10, FIG. 3).

TABLE 1

| Number | Type of steel | Strip thickness [mm] | Strip width [mm] |
|---|---|---|---|
| 00DAT | Low carbon content | 1.4 | 1200 |

Hereafter, by "thickness of cast slab" we mean the thickness of the slab as it exits from the continuous casting machine, following the soft-reduction or not.

For the rolling line 10 according to the present invention (FIG. 3), we assume as an example a thickness of cast slab of 70 mm, with the possibility of a hot core reduction immediately downstream of casting, thanks to the roughing stand 20, up to about 35 mm.

For the thin-slab rolling line 60, in order to investigate the impact on productivity of the slab thickness, two different constant thicknesses of cast slab were considered, respectively 50 mm and 70 mm.

As a result, the rolling programs were calculated for the following four processes summarized in Table 3.

TABLE 3

| | Layout | Slab thickness [mm] |
|---|---|---|
| CASE A | Rolling line 50, FIG. 1 | 220 |
| CASE B | Rolling line 10 according to the present invention, FIG. 3 | Slab cast: 70 mm<br>Slab thickness reduced adaptively to 35 mm |
| CASE C | Rolling line 60, FIG. 2 | 70 |
| CASE D | Rolling line 60, FIG. 2 | 35 |

Table 4 summarizes some significant rolling parameters of the Steckel reversing rolling train 22 for CASE B, for each of the five rolling programs 01DAT, 02DAT, 03DAT, 04DAT and 00DAT. CASE B provides three double rolling passes in the two-stand Steckel, indicated by RF1-1 (first reduction of first pass), RF2-1 (second reduction of first pass), RF2-2 (first reduction of second pass), RF1-2 (second reduction of second pass), RF1-3 (first reduction of third pass), RF2-3 (second reduction of third pass). In all cases the thickness of the intermediate thin slab fed to the Steckel is 40 mm, except for the 04DAT rolling program, where the thickness is 50 mm.

TABLE 4

| Name of rolling pass | Thickness [mm] | Force [mtons] | | | Torque [kg-m] | | |
|---|---|---|---|---|---|---|---|
| | | Head | Center | Tail | Head | Center | Tail |
| 01DAT | | | | | | | |
| RF1-1 | 23.5 | 1887 | 1883 | 1881 | 154076 | 153578 | 153576 |
| RF2-1 | 11.8 | 2293 | 2265 | 2283 | 150465 | 148661 | 149825 |
| RF2-2 | 6.0 | 2499 | 2321 | 2424 | 111318 | 103422 | 107975 |
| RF1-2 | 3.25 | 2613 | 2260 | 2515 | 77154 | 66776 | 74247 |
| RF1-3 | 2.1 | 2437 | 1961 | 2142 | 43908 | 35380 | 38624 |
| RF2-3 | 1.6 | 1871 | 1474 | 1590 | 21691 | 17296 | 18581 |
| 02DAT | | | | | | | |
| RF1-1 | 23.0 | 1850 | 1845 | 1846 | 153140 | 152720 | 152757 |
| RF2-1 | 12.5 | 1956 | 1936 | 1951 | 121965 | 120739 | 121641 |
| RF2-2 | 6.9 | 2053 | 1940 | 2019 | 90221 | 85277 | 88728 |
| RF1-2 | 4.0 | 2098 | 1863 | 2043 | 64385 | 57183 | 62697 |
| RF1-3 | 2.7 | 1875 | 1551 | 1680 | 36952 | 30612 | 33129 |
| RF2-3 | 2.0 | 1681 | 1358 | 1456 | 24055 | 19626 | 20972 |
| 03DAT | | | | | | | |
| RF1-1 | 27.0 | 2173 | 2173 | 2172 | 163656 | 163681 | 163636 |
| RF2-1 | 16.2 | 2638 | 2638 | 2644 | 165999 | 166023 | 166357 |
| RF2-2 | 11.0 | 2130 | 2079 | 2111 | 91772 | 89592 | 90944 |
| RF1-2 | 7.5 | 2198 | 2071 | 2160 | 75829 | 71459 | 74502 |
| 74502 | 5.4 | 2098 | 1925 | 2002 | 54890 | 50378 | 52378 |
| RF2-3 | 4.0 | 2075 | 1894 | 1961 | 45024 | 41285 | 42666 |
| 04DAT | | | | | | | |
| RF1-1 | 35.0 | 1961 | 1962 | 1959 | 165537 | 165599 | 165391 |
| RF2-1 | 24.8 | 1842 | 1843 | 1841 | 117569 | 117612 | 117468 |
| RF2-2 | 18.0 | 1798 | 1797 | 1804 | 92830 | 92772 | 93114 |
| RF1-2 | 13.0 | 1832 | 1792 | 1826 | 78101 | 76411 | 77846 |
| RF1-3 | 10.0 | 1563 | 1536 | 1562 | 50429 | 49563 | 50399 |
| RF2-3 | 8.0 | 1401 | 1380 | 1401 | 38264 | 37708 | 38245 |
| 00DAT | | | | | | | |
| RF1-1 | 23.1 | 1900 | 1895 | 1897 | 156695 | 156320 | 156443 |
| RF2-1 | 11.6 | 2251 | 2221 | 2244 | 146281 | 144317 | 145820 |
| RF2-2 | 5.9 | 2494 | 2296 | 2405 | 110048 | 101331 | 106132 |
| RF1-2 | 3.0 | 2874 | 2457 | 2753 | 86857 | 74307 | 83200 |
| RF1-3 | 1.85 | 2785 | 2200 | 2415 | 49451 | 39136 | 42933 |
| RF2-3 | 1.4 | 2052 | 1582 | 1713 | 21584 | 17051 | 18389 |

FIG. 4 shows a Table 5 which shows the results of the production comparison for the various configurations.

The comparison between the various configurations is done assuming CASE A as the reference case, which obtains an annual production of 1.2 Mtpy. In CASE A, the rolled products required seven double passes or, where possible, two individual passes and five double passes, but in any case a high number and expensive.

CASE B, which shows the rolling line and method according to the present invention, allowed to increase the productivity of the rolling mill compared with CASE A by about 24%, obtaining 1.5 Mtpy. Thanks to the reduction in thickness with the roughing stand 20 directly connected immediately at exit from the continuous casting machine 12, it is possible to set on each occasion, for the Steckel rolling train 22, an appropriate slab thickness also as a function of the type of steel that can be rolled, again in three double passes. In CASE B, the thickness of the rolled slab is kept constant at 70 mm, thus giving benefits in terms of the stability of the continuous casting operation and the quality of the steel, while the roughing stand 20 adapts the thickness cast to an optimum value for the rolling mill comprised between 35 and 70 mm. In this case, an average casting speed of 5.4 m/min is required, to meet production requirements.

CASE C refers to a constant thickness of cast slab of 70 mm. This configuration does not give any improvement in production compared with the mode that starts from a thick slab. In CASE C, it is not possible to complete the rolling process in three double passes, but at the same time they may be excessive. Furthermore, the limitation to the discharge speed from the furnace, coupled with the constraint of the inverse winding passes, does not allow an optimum program of passes. The average casting speed, combined with this production speed, is about 4.4 m/min in CASE C.

CASE D refers to a constant thickness of the cast slab of 50 mm. This configuration allows to increase the productivity of the rolling mill, compared with CASE A, by about 15%, with an annual production of about 1.4 Mtpy. With this thickness of cast slab, in accordance with the final thickness of the strip, it is possible to complete rolling in three double passes, or with two single passes followed by three double passes. On the other hand, however, this configuration requires a high casting speed, on average 7.0 m/min, and thus has more stressed working conditions.

No significant differences in the mean temperature of the body of the strip were found, either starting from a thick slab (CASE A), or starting from a thin slab (CASE B, C and D). The lack of homogeneity between the hot body and the cold heads and tails is generated during the last rolling passes when the material is thin and the bar is long.

In the process with the thin slab, the temperature of the body is constant for a longer part of the length of the slab, thanks to the winding process after the first double pass, keeping the temperature uniform at exit from the tunnel furnace.

It should also be noted that the process with the thin slab allows to obtain a thinner thickness compared with the process with the thick slab, for example to a thickness of about 1.4 mm. One reason for this result may be found in a more stable rolling condition, which allows to control the geometric parameters better, thanks to a smaller number of passes required, with a reduced specific mean rolling load.

When the number of passes is minimized, as in CASE B according to the present invention, the mean rolling temperature is higher and more constant, allowing a milder rolling step.

In conclusion, CASE B according to the present invention allows the greatest increase in productivity, about 25%, compared with the process with the thick slab. Furthermore, CASE B, compared to the process with the thin slab (CASE C and CASE D), thanks to roughing immediately after casting, allows a tailor-made thickness for the optimum operating conditions of the Steckel (35-70 mm) and, on the other hand, allows more stable working conditions for casting with a thickness of 70 mm. CASE D, in particular, on the contrary, although it gives a reasonable increase in productivity (15%), creates much more stressed working conditions, and in particular needs a high casting speed. CASE C does not give any benefit in the process in terms of productivity, due to an unfavorable distribution of the rolling passes.

The invention claimed is:

1. A rolling line for production of flat products, comprising:

a casting machine suitable to continuously cast a thin slab;

a temperature maintenance and homogenization unit;

a rolling unit including a Steckel rolling train with two reversing stands downstream of the temperature maintenance and homogenization unit;

at least one forming or roughing stand connected to the exit of the casting machine and upstream of the temperature maintenance and homogenization unit for reducing the thickness of the thin slab just solidified, the at least one forming or roughing stand being configured to perform an adaptive reduction of the thickness of the thin slab smaller than or equal to about 65% at least as a function of the thickness, width and type of material of the finished flat product, wherein the rolling unit is configured for performing at most three double rolling passes through the two reversing stands, wherein each of the double rolling passes includes a pass of the rolled product in a forward direction through the two reversing stands, and then a pass of the rolled product in an inverse to the forward direction through the two reversing stands, which reduces the thickness of the rolled product to produce a flat product having a final thickness between about 1.2 mm and about 20 mm; and a shearing unit disposed upstream of the at least one forming or roughing stand.

2. The rolling line as in claim 1, wherein the casting machine is suitable to cast, at an average casting speed comprised between about 5 m/min and 7 m/min, a thin slab with a constant thickness smaller than or equal to about 130 mm, and wherein the at least one forming or roughing stand is suitable to perform an adaptive reduction of the thickness of the cast slab to a thickness comprised between about 30 mm and about 80 mm.

3. The rolling line as in claim 1, wherein the diameter of each of the rolling rolls of the at least one forming or roughing stand is comprised between about 650 mm and about 750 mm.

4. The rolling line as in claim 1, wherein the temperature maintenance and homogenization unit comprises a tunnel furnace of a length sized to allow, during stoppages of the rolling unit, to accumulate inside it some thin slabs for at least 8 minutes at a casting speed being in the range of from about 3 m/min to 12 m/min.

5. The rolling line as in claim 1, wherein the rolling stands which constitute the at least one forming or roughing stand are of the four-high stand type.

6. The rolling line as in claim 1, comprising at least a rapid heating unit of the cast material disposed between the casting machine and the rolling unit.

7. The rolling line as in claim 1, further comprising:

a cooling unit; and one or more winding units of the final product, wherein the cooling unit and the one or more winding units of the final product are downstream of the rolling unit.

8. The rolling line as in claim 1, wherein the temperature maintenance and homogenization unit includes a tunnel furnace.

9. The rolling line as in claim 1, further comprising winding/unwinding reels, and the at least two reversing stands of the Steckel reversing train are in cooperation with the winding/unwinding reels.

10. The rolling line as in claim 1, further comprising winding/unwinding reels, wherein the winding/unwinding reels include a heated reel.

11. The rolling line as in claim 1, further comprising a drawing unit; and a winding/unwinding reel, wherein the winding/unwinding reel is configured to cooperate with the drawing unit.

12. A method for production of flat products, the method comprising:

a continuous casting step of a thin slab;

a temperature maintenance and homogenization step;

a rolling step subsequent to the temperature maintenance and homogenization step;

a shearing step, for shearing the thin slab; and a forming or roughing step for reducing the thickness of the thin slab solidified, performed after the casting step and the shearing step, and before the temperature maintenance and homogenization step, the forming or roughing step includes performing an adaptive reduction of the thickness of the thin slab smaller than or equal to about 65% at least as a function of the thickness, width and type of material of the finished flat product, and the rolling step includes performing a reduction of the thickness of the rolled product emerging from the forming or roughing step to a final thickness of between about 1.2 mm and about 20 mm by carrying out at most three double rolling passes through a double rolling stand, wherein each of the double rolling passes includes passing of a rolled product in a forward direction through the double rolling stand, and then passing of the rolled product in an inverse to the forward direction through the double rolling stand.

13. The method as in claim 12, wherein the casting step is performed at a speed comprised between about 5 m/min and 7 m/min of a thin slab with a constant thickness smaller than or equal to about 130 mm, and in that the forming or roughing step performs an adaptive reduction of the thickness of the thin slab to a thickness of between 30 mm and about 80 mm.

14. The method as in claim 12, wherein in the first double rolling pass a first reduction of thickness performed is between about 30% and 40%.

15. The method as in claim 12, wherein in the first double rolling pass a second reduction of thickness performed is between about 30% and 52%.

16. The method as in claim 12, wherein in the second double rolling pass a first reduction of thickness performed is between about 28% and 50%.

17. The method as in claim 12 wherein in the second double rolling pass a second reduction of thickness performed is between about 28% and 50%.

18. The method as in claim 12, wherein in the third double rolling pass a first reduction of thickness performed is between about 24% and 39%.

19. The method as in claim 12, wherein in the third double rolling pass a second reduction of thickness performed is between about 20% and 25%.

* * * * *